United States Patent [19]

Petersen

[11] 4,169,625

[45] Oct. 2, 1979

[54] KNOCK-DOWN PEDESTAL CHAIR

[75] Inventor: Warren D. Petersen, St. Charles, Ill.

[73] Assignee: Burd, Inc., Howell Division, St. Charles, Ill.

[21] Appl. No.: 893,807

[22] Filed: Apr. 5, 1978

[51] Int. Cl.[2] ..... A47C 1/02

[52] U.S. Cl. ..... 297/349; 248/165; 248/188.7; 248/425; 297/440

[58] Field of Search ..... 108/150, 139–142; 248/158, 159, 165, 188.7, 415, 425; 297/349, 411, 346, 421, 440, 442, 455

[56] References Cited

U.S. PATENT DOCUMENTS

| | | | |
|---|---|---|---|
| 1,039,134 | 9/1912 | Jenkins | 108/139 |
| 1,854,663 | 4/1932 | Nebel | 297/440 X |
| 2,474,318 | 6/1949 | Molla | 248/165 X |
| 2,678,088 | 5/1954 | Jamison | 297/440 X |
| 3,301,597 | 1/1967 | Bereday | 297/445 X |
| 3,424,423 | 1/1969 | Hampton | 248/188.7 X |
| 3,617,023 | 4/1970 | Schneider | 248/188.7 |
| 3,663,055 | 5/1972 | Gale | 297/440 X |
| 3,663,059 | 5/1972 | Omilie | 297/440 |
| 3,874,729 | 4/1975 | Blodee | 297/440 X |
| 3,966,252 | 6/1976 | Albinson | 297/411 X |
| 4,054,317 | 10/1977 | Stumpf | 297/349 X |
| 4,097,089 | 6/1978 | Peterson | 297/440 X |

*Primary Examiner*—James C. Mitchell

*Attorney, Agent, or Firm*—Hill, Van Santen, Steadman, Chiara & Simpson

[57] ABSTRACT

A knock-down pedestal chair is easily assembled from metal frame and base components and upholstered back and cushion components requiring only a small shipping carton and a few screws, bolts and nuts for assembly of the components into the finished chair. The metal components can be mounted in close relation on a plating rack for easy electroplating in standard plating facilities. The pedestal base has a pair of planar leg components each composed of two diametrically opposite legs connected by an interposed slotted plate. The slots of the plates of the two components interfit to hold the components at right angles to each other. The tops of the legs are easily bolted to the bottom plate of a swivel plate component, the top plate of which is bolted to the bottom of the seat component and side arm components are bolted to the sides of the seat component and are fastened to the back component to complete the chair assembly. Casters may be mounted under the four legs of the base.

17 Claims, 6 Drawing Figures

KNOCK-DOWN PEDESTAL CHAIR

FIELD OF THE INVENTION

This invention relates to the art of knock-down articles of furniture having components which can be shipped in small packages and easily assembled after shipment. Specifically the invention deals with a swivel chair formed from metal frame components and seat and back components which are easily assembled by a few fasteners.

BACKGROUND OF THE INVENTION

Heretofore, pedestal base chairs were formed of bulky components requiring large shipping cartons. Electroplating of metal bases and other metal frame parts for such chairs required special rack holders and large plating baths to accommodate the bulky components. Uniform electroplate finishes were difficult to achieve.

SUMMARY OF THIS INVENTION

This invention now greatly simplifies and decreases the cost of pedestal base articles of furniture such as swivel chairs and the like by providing planar metal components which can easily be electroplated with standard available equipment, shipped in disassembled compact condition, and easily assembled at destinations with a few fasteners.

Specifically, a chair of this invention may be formed from two planar metal arms, two planar metal pedestal components, one swivel plate component, one seat component, one back component, and four casters using only two wood screws, four nuts and bolts, and eight bolts.

In the preferred chair of this invention, a pedestal base has four identical "J" shaped legs arranged horizontally in two planar components. Each component has two diametrically opposite legs connected by an interposed slotted plate holding the elongated portions of the legs in oppositely extending horizontal positions with the inner ends of these horizontal portions curved to spaced parallel upright portions which are curved outwardly at their upper ends and have flattened apertured terminal portions. The slot of the plate of one component opens upwardly while the slot of the plate of the other component opens downwardly. The two plates are, therefore, interfitted through their mating slots to secure the two components in right angular relation thereby positioning the legs in quadrants. A swivel plate component has a bottom plate for resting on the flat terminal top ends of the legs and has apertures registering with the apertures of these terminal ends to receive bolts therethrough which are tightened by nuts to anchor the swivel unit on top of the pedestal base. The top plate of the swivel unit is also apertured and is rotated to expose the apertures so that bolts can be inserted and threaded into nuts secured in the central portion of the bottom of the seat unit.

A pair of tubular arm frames of rectangular cross section have horizontal bottom legs with short upright front legs and longer back legs and with inclined top legs connecting the front and rear legs. Tubular sockets join the rear ends of the top legs with the top ends of the back legs.

A flange plate extends from the central portion of the bottom leg of each arm component to underlie the adjacent side of the seat. These plates are apertured to receive bolts which are threaded into nuts secured in the base of the seat near the sides thereof.

The back component is a cylindrical upholstered roll with a wooden dowel extending therethrough and having exposed ends for seating in the sockets of the arm components. Wood screws inserted through holes in the sockets are threaded into the ends of the wooden dowel.

The outer ends of the horizontal portions of the legs receive plastic end plugs and have bottom apertures registering with holes in the plugs to receive the stems of swivel casters.

A very attractive, comfortable, pedestal base swivel chair is thus easily assembled by a purchaser from planar components that can be compactly packaged.

It is then an object of this invention to provide a knock-down article of furniture with a pedestal base formed from planar units having slotted interfitting plates which are locked together with a seat supporting plate.

Another object of the invention is to provide a pedestal base swivel chair composed of two planar pedestal components, two arm components, one swivel plate component, one seat component, and one back component and requiring only a few fasteners to secure all of the components in fixed assembled relation.

Another object of the invention is to provide a knock-down article of furniture having a pedestal base with radiating legs composed of planar units interfitted together and locked by a seat supporting swivel plate.

Another object of the invention is to provide a pedestal base for an article of furniture composed of a plurality of planar units each having diametrically opposed "J" shaped legs and a slotted plate and interfitting together to lock the legs in equally spaced radiating relation.

Other and further objects of this invention will be apparent to those skilled in this art from the following detailed description of the annexed sheets of drawings which, by way of a preferred example, illustrate one embodiment of this invention.

ON THE DRAWINGS

AS SHOWN ON THE DRAWINGS

Figure 1:
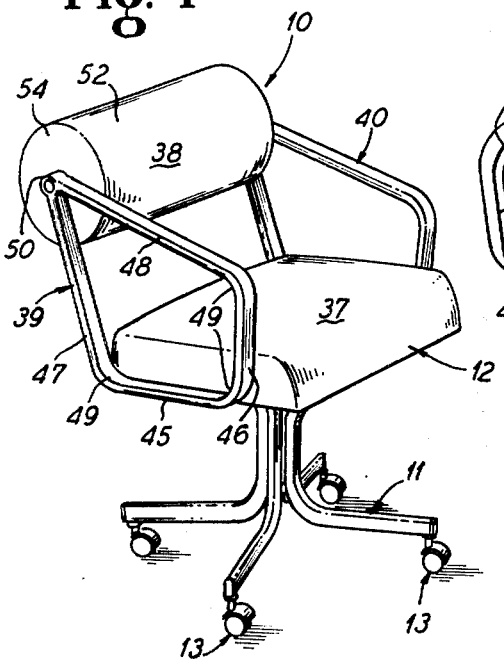
FIG. 1 is a side and front perspective view of an assembled pedestal swivel chair of this invention.
Figure 2:
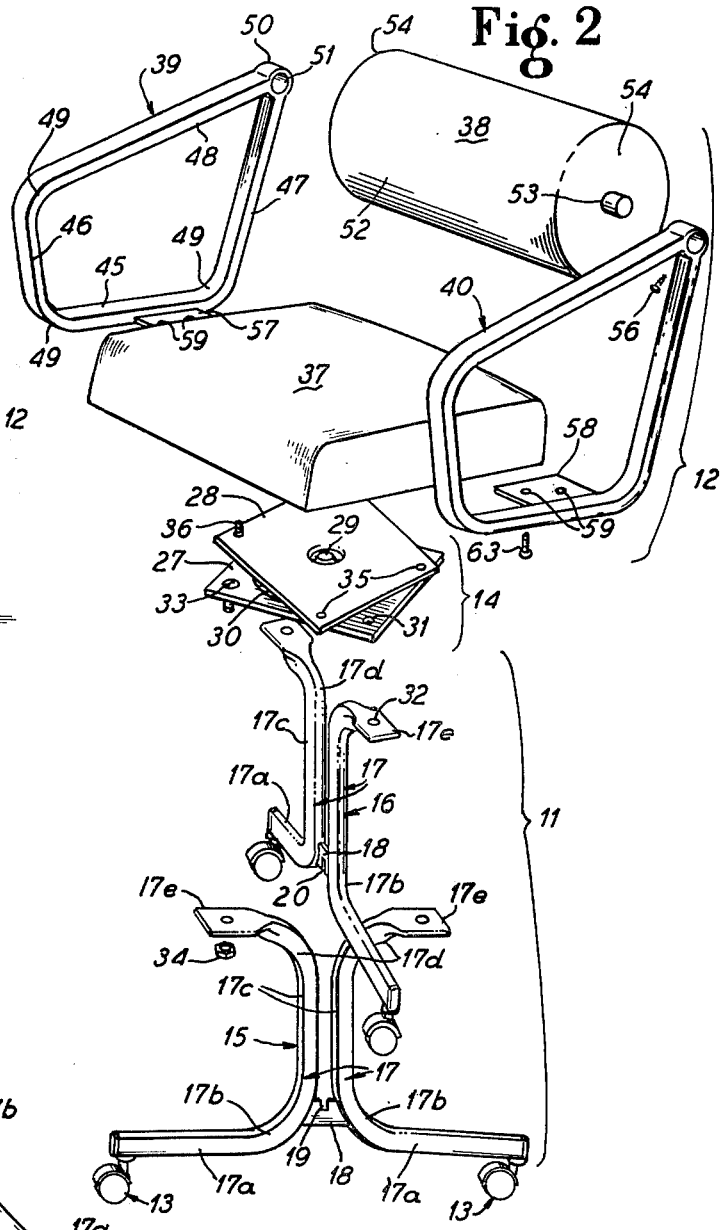
FIG. 2 is an exploded perspective view of the components of the chair of FIG. 1 arranged in juxtaposed relation to illustrate the manner in which the planar components are assembled to form the finished chair.

The chair 10 of FIG. 1 has a four-leg pedestal base 11 on top of which a chair seat, arm, and back assembly 12 is mounted and from the bottom of which swivel casters 13 depend. As shown in FIG. 2, a swivel plate assembly 14 is interposed between the pedestal base 11 and the chair unit 12.

The pedestal base 11 is composed of two planar leg units 15 and 16. Each leg unit 15 and 16, in turn, is composed of a pair of oppositely facing "J" shaped tubular legs 17 having outwardly extending elongated horizontal portions 17*a*, curved upward at 17*b* at their inner ends into upright vertical legs 17*c*, curved outwardly at 17*d* at their upper ends and terminating in outwardly facing flat flanges 17*e*. The curved portions 17*b* are welded to the outer ends of an interposed plate 18 which fixedly secures the pair of legs 17,17 in outwardly facing relation in the same plane.

The plate 18 of the pedestal unit 15 shown in FIG. 2 has an upwardly opening slot 19 while the plate 18 of the leg unit 16 has a downwardly opening slot 20.

Figure 3:
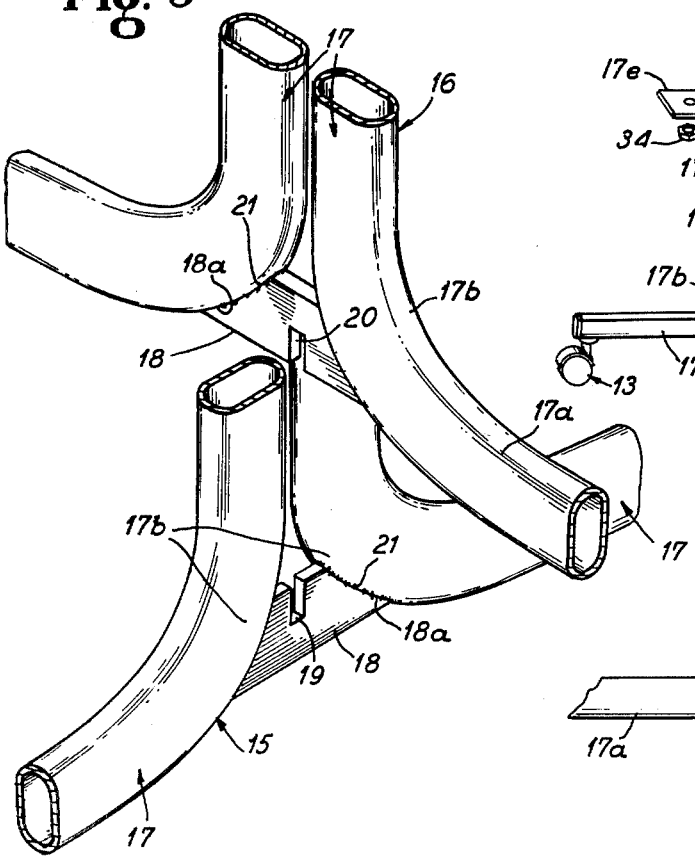
FIG. 3 is an enlarged fragmentary perspective view of the planar pedestal leg components positioned for assembly.

As better shown in FIG. 3, the plates 18 have concave outer ends 18*a* fitting the adjoining inner faces of the curved portions 17*b* of the legs 17 and weld bonds 21 between these outer edges 18*a* and the curved faces of the leg portions 17*b* integrally unite the plates to the legs.

Figure 6:
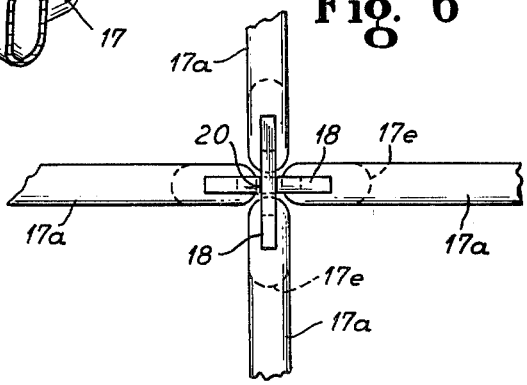
FIG. 6 is a fragmentary bottom plan view along the lines VI—VI of FIG. 4.
Figure 5:
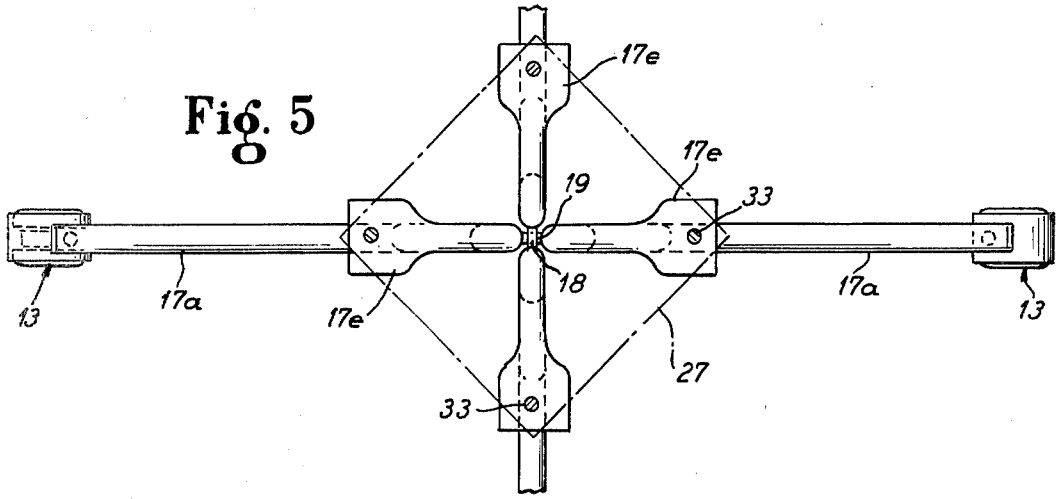
FIG. 5 is a horizontal cross-sectional view along the lines V—V of FIG. 4 with the overlying plate shown in dotted lines.

The slots 19 and 20 of the plates 18 extend only about halfway through the height of the plates and interfit with the side walls of the slots abutting the side faces of the adjacent plate to lock the plates together in right angular relation thereby holding the planar leg units 15 and 16 at right angles and positioning the outturned legs 17*a* and the terminal ends 17*e* in equally spaced quadrant relation as shown in FIGS. 5 and 6.

Figure 4:
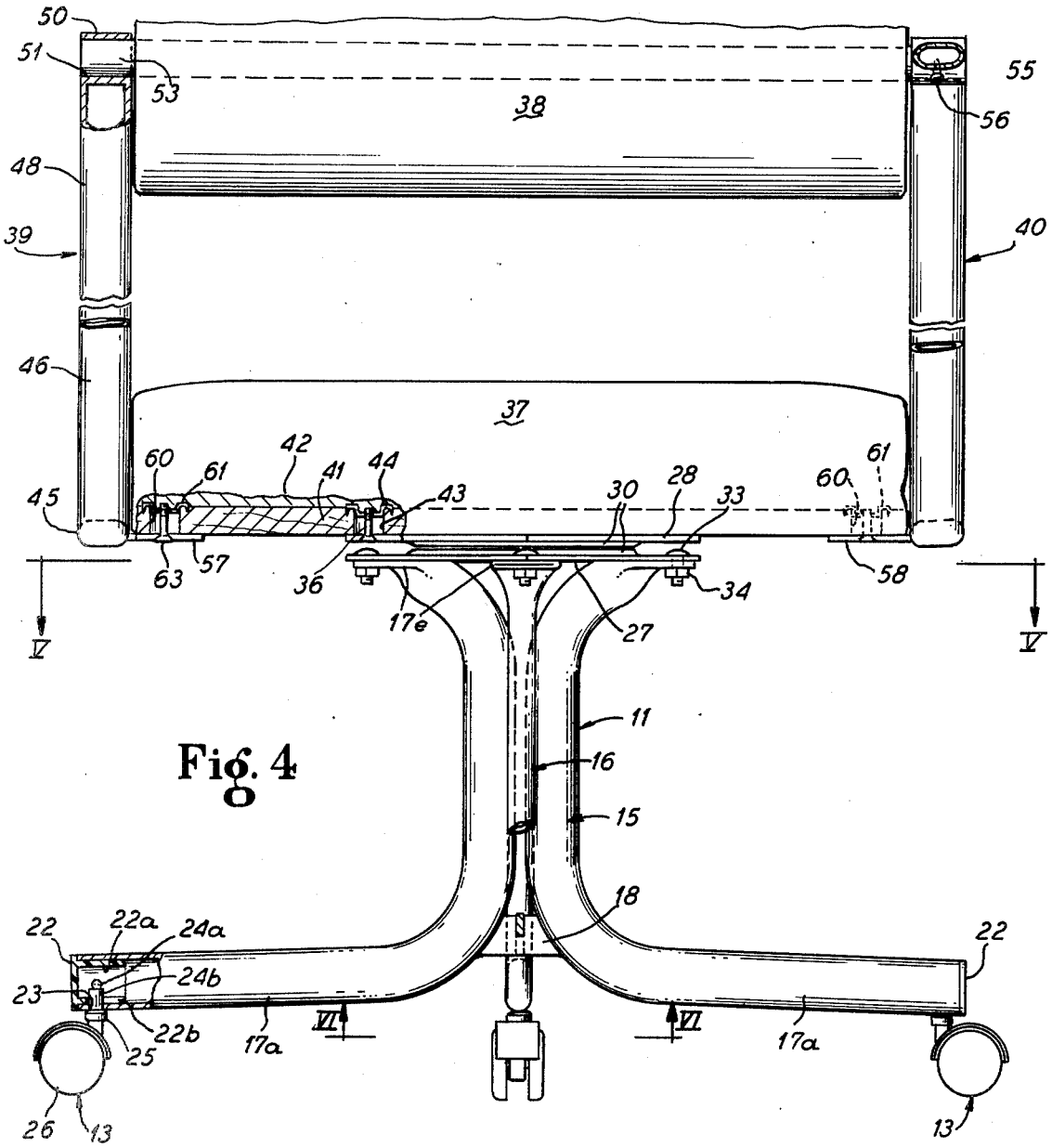
FIG. 4 is a fragmentary front elevational view of the chair of FIG. 1 with parts broken away to show underlying structure.

As shown in FIG. 4, the outer open ends of the outwardly facing tubular leg portions 17*a* receive hollow plastic plugs 22. These plugs have tubular shank portions 22*a* tightly fitting the interior of the tubular legs and an inwardly opening slot 22*b* is provided in each shank to overlie an aperture 23 in the bottom face of each leg portion 17*a* immediately adjacent the outer end of the leg. The swivel caster 13 has a stem 24*a* extending freely through a socket 24*b* which is press fitted in the hole 23 and slot 22*b* of the plug shank 22*a* and a collar 25 on the socket 24*b* bottoms against the bottom face of the leg portion 17*a* to position the wheel or roller 26 of the caster in spaced relation below the bottom of the leg portion 17*a*.

As shown in FIG. 2, the swivel plate unit 14 is composed of a square flat bottom plate 27 and a square flat top plate 28 connected by a stud 29 so that the plates can rotate relative to each other in superimposed relation. If desired, the plates can have raised races 30 (FIG. 4) for ball bearings (not shown) to facilitate ease of rotation under load.

The bottom plate 27 has four apertures 31, one being positioned in each corner thereof to register with an aperture 32 in an underlying flange 17*e* of a leg 17.

The top plate 28 is rotated, as shown in FIG. 2, to expose the four corners of the bottom plate 27 and bolts such as 33 are dropped through the exposed apertures 31 and through the underlying apertures 32 to receive nuts 34 which when tightened on the bolts will mount the plate 27 horizontally on top of the terminal ends 17*e* of the legs 17 thereby also locking the interfitted leg units 15 and 16 in fixed right angle relation.

The top plate 28 of the swivel unit 14 has also four holes 35 therethrough, one being positioned in each corner and receiving a bolt 36 therethrough with its threaded shank extending above the plate 28.

The chair unit 12 to be mounted on the pedestal base 11 through the swivel plate unit 14 is formed from an upholstered seat component 37, an upholstered back component 38, and a pair of metal arm components 39 and 40.

As shown in FIG. 4, the seat component 37 has a rigid base board 41 and overlying upholstery 42. Four holes 43 are formed through the base board 41 in position to register with the holes 35 of the swivel plate 28. A tanged nut 44 is imbedded in the mouth of each hole 43 to receive the threaded shank of a bolt 36 in threaded relation therethrough. Thus four bolts 36 are threaded into four nuts 44 carried by the base board 41 of the seat unit 37 to fixedly unite the seat on top of the plate 28.

The side or arm components 39 and 40 each have a horizontal bottom leg 45, an upstanding front leg 46, an upstanding backwardly sloping longer back leg 47 and a top arm rest leg 48 sloping upwardly and rearwardly from the top of the front leg 46 to the top of the back leg 47. The legs 45,46,47 and 48 are connected at rounded corners 49 but the top of the rear leg 47 and the back end of the top leg 48 are connected by a tubular socket 50 forming an attractive transition between these two legs. The socket 50 has an open ended cylindrical bore 51 therethrough.

The back component 38 has a cylindrical upholstered roll 52 surrounding a central wooden dowel 53 which projects beyond both ends 54 of the roll 52 for distances sufficient to fill the bores 51 of the side frame components 39 and 40. A snug fit is provided between the dowel 53 and the bores 51.

The wall of the socket 50 has a screw hole therethrough between the legs 47 and 48 for receiving a wood screw 56 threaded into the dowel 53 in the socket bore 51.

The frame component 39 has a flange plate 57 extending laterally inward from the midportion of the bottom leg 45 to underlie the bottom board 41 of the seat component 37 at the adjacent side of the seat component. An identical plate 58 extends inwardly from the opposite frame component 40 to underlie the seat board 41 at the opposite side of the seat component. The plates 57 and 58 each have two apertures 59 therethrough adapted to register with holes 60 in the seat board 41. These holes 60 have tang nuts 61 overlying the mouths thereof and anchored in the board 41 receiving bolts 63 bottomed on the plates 57 and 58 and threaded into the nuts 61 for securing the side frame components 39 and 40 to the opposite sides of the seat 37. It will thus be understood that the frames 39 and 40 are identical except for the oppositely facing plates 57 and 58.

From the above description, it will be understood that the pedestal base swivel chair 10 of this invention is composed of flat planar components 15 and 16 providing the base 11, a swivel plate component 14 locking the base components 15 and 16 together and rotatably supporting a seat component 37 to the sides of which are attached side frame components or arm rests 39 and 40 which also support a back component 38. The pedestal base has tubular "J" shaped legs preferably of oval cross section. Swivel caster units depend from the outer ends of the bottoms of these legs. The side arm components 39 and 40 are also tubular but preferably have a rectangular cross section. The components 13,14,15,16,37,38,39 and 40 can be packed flat in a small carton and are easily assembled to provide the finished chair 10 by four nut and bolt assemblies 33 and 34, four bolts 36, four bolts 63, and two wood screws 56. The casters are also easily snap-fitted into the pedestal legs and plugs carried in the outer ends of these legs.

The metal components 15,16,39 and 40 and, if desired, 14 are easily closely positioned on conventional racks for electroplating in conventional facilities.

I claim as my invention:

1. A pedestal base swivel chair formed of flat planar components which comprises an upholstered back unit with dowel ends projecting therefrom, a seat unit, a pair of arm frames with flanges for underlying the sides of the seat unit and sockets for receiving the dowel ends, a pair of leg units each having two planar diametrically opposed legs connected by plates with interfitting slots, a swivel unit having a bottom plate for overlying the leg units and a top plate for underlying the seat unit, said leg units being held in right angle relation by said interfitting slots, nut and bolt assemblies locking the leg units to said bottom plate of the swivel unit, said seat unit having a base board with bolt holes overlying the top plate of the swivel unit and the flanges of the arm frames, nuts secured to said base board over the mouths of said bolt holes, bolts threaded in said nuts securing the top plate of said swivel unit and said flanges to said base board, wood screws extending through said sockets threaded into said dowel ends securing the back unit to the arm frames, and a swivel caster depending from each leg of the leg units.

2. A knock-down swivel pedestal base chair composed of planar components including a pair of leg units each having opposite facing "J" shaped tubular legs with elongated base portions, upright portions at the inner ends of the bottom leg portions, and outturned flat flange portions at the top of the upstanding leg portions, the two "J" shaped legs of each component being connected by an upright slotted plate, the slot of one plate opening upwardly, the slot of the other plate opening downwardly, said plates being interfitted through said slots in right angle relation to position the bottom legs equally spaced in four quadrants, a swivel plate component having a bottom plate bolted to the flat flanges of said legs, a seat unit overlying said swivel plate component and bolted thereto, a pair of tubular arm frames each having a bottom leg, upstanding front and rear legs, and an inclined arm rest top leg, the top end of said rear leg and the rear end of said arm rest leg of each frame being joined by a socket with a cylindrical bore therethrough, flanges on said bottom legs of said arm rest units underlying the seat unit, fasteners securing said flange to said seat unit, a back rest unit having dowel ends seated in said sockets, and fasteners securing said dowel ends in said sockets.

3. A four-leg pedestal base chair composed of planar components which comprises a pair of leg units having oppositely facing horizontal "J" shaped legs joined by an interposed upstanding plate having a top opening slot, a second leg unit having a pair of oppositely facing horizontal "J" shaped legs joined by an upstanding plate with a downwardly opening slot, said slotted plates interfitting to hold the pair of leg units in right angle relation to form a pedestal base with four equally spaced radiating horizontal leg portions at the top and bottom of the base, a swivel unit having a bottom plate bolted to the four horizontal leg portions at the top of said base and a top plate rotatably mounted on said bottom plate, a seat unit, bolted on top of said top plate, side arms bolted to the seat unit, and a back unit secured to the side arms.

4. The chair of claim 1 wherein the legs of the leg units are metal tubes of oval cross section with the major axis lying in the plane of the planar leg units.

5. The chair of claim 1 wherein the arm frames are tubular.

6. The chair of claim 5 wherein the tubular arm frames have a rectangular cross section with flat horizontal top faces.

7. The chair of claim 1 wherein four nut and bolt assemblies lock the leg units to the bottom plate of the swivel unit, four bolts secure the top plate of the swivel unit to the base board of the seat unit, two bolts secure each flange of a side arm to the base board of the seat unit, and two wood screws secure the dowel ends to the sockets.

8. The chair of claim 1 wherein the plates of the swivel unit are square and have bolt holes through the corners thereof.

9. The chair of claim 2 wherein the socket of each arm rest has a transverse hole therethrough and the fastener securing the dowel end in the socket is a wood screw extending through said hole.

10. The chair of claim 9 wherein said hole is between the top and rear legs of the arm frames.

11. The chair of claim 2 wherein the "J" shaped legs have bottom portions radiating horizontally in equally spaced relation and casters depend from the outer ends of said horizontal portions.

12. The chair of claim 11 wherein the outer ends of said horizontal leg portions are closed by plastic plugs and the casters have stems extending into said plugs.

13. The chair of claim 2 wherein the swivel plate component has square top and bottom plates rotatably connected at their centers and have bolt holes in the four corners thereof.

14. The chair of claim 2 wherein the leg units, and the arm frames are electroplated metal components.

15. The chair of claim 3 wherein the "J" shaped legs are metal tubes of oval cross section.

16. The chair of claim 3 wherein the four radiating horizontal leg portions at the bottom of the base are substantially longer than the four radiating horizontal leg portions at the top of the base.

17. The chair of claim 16 wherein the horizontal leg portions at the top and bottom of the base are merged into vertical leg portions through curved bends.

* * * * *